US011674751B2

(12) United States Patent
Deprez et al.

(10) Patent No.: US 11,674,751 B2
(45) Date of Patent: Jun. 13, 2023

(54) LYOPHILISATION CONTAINER

(71) Applicant: MaaT PHARMA, Lyons (FR)

(72) Inventors: Alicia Deprez, Lyons (FR); Carole Schwintner, Lyons (FR)

(73) Assignee: MaaT PHARMA, Lyons (FR)

( * ) Notice: Subject to any disclaimer, the term of this patent is extended or adjusted under 35 U.S.C. 154(b) by 191 days.

(21) Appl. No.: 17/279,532

(22) PCT Filed: Sep. 24, 2019

(86) PCT No.: PCT/FR2019/052228

§ 371 (c)(1),
(2) Date: Mar. 24, 2021

(87) PCT Pub. No.: WO2020/065195

PCT Pub. Date: Apr. 2, 2020

(65) Prior Publication Data

US 2021/0396467 A1 Dec. 23, 2021

(30) Foreign Application Priority Data

Sep. 27, 2018 (FR) ..... 1858895

(51) Int. Cl.
*F26B 5/06* (2006.01)

(52) U.S. Cl.
CPC ..... *F26B 5/06* (2013.01)

(58) Field of Classification Search
CPC ..... F26B 5/06
USPC ..... 34/60, 92
See application file for complete search history.

(56) References Cited

U.S. PATENT DOCUMENTS 2,574,663 A 11/1951 Sampson
3,446,635 A 5/1969 Nelson et al.
4,460,368 A * 7/1984 Allison ..... A61K 9/7023 424/449
5,257,983 A * 11/1993 Garyantes ..... F26B 25/16 604/408
5,309,649 A * 5/1994 Bergmann ..... F26B 5/06 34/92

(Continued)

FOREIGN PATENT DOCUMENTS

CN 112789472 A * 5/2021 ..... F26B 5/06
EP 3949732 A1 * 2/2022 ..... A01N 1/0252

(Continued)

OTHER PUBLICATIONS

International Search Report for PCT/FR2019/052228, dated Nov. 22, 2019, 2 pages.

*Primary Examiner* — Stephen M Gravini
(74) *Attorney, Agent, or Firm* — ArentFox Schiff LLP

(57) ABSTRACT

The invention relates to a container for the lyophilisation of a liquid or semi-liquid product. The container comprises an upper portion (2) provided with a membrane which is permeable to water vapour and a lower portion (3) comprising a reservoir designed to receive the product on a bottom. The container comprises internal partitions (21) in the reservoir (19) which form a plurality of product-receiving volumes (22-27), the internal partitions (21) being configured such that introducing product into one of the predefined receiving volumes (22) causes said receiving volumes (22-27) to be successively filled in a predetermined order.

14 Claims, 6 Drawing Sheets

(56) References Cited

U.S. PATENT DOCUMENTS

| | | | | |
|---|---|---|---|---|
| 5,522,155 | A * | 6/1996 | Jones | B65D 51/1683 34/286 |
| 5,596,814 | A * | 1/1997 | Zingle | F26B 5/06 34/296 |
| 5,727,333 | A * | 3/1998 | Folan | F26B 5/065 34/92 |
| 6,199,297 | B1 * | 3/2001 | Wisniewski | F26B 5/06 206/439 |
| 8,449,520 | B2 * | 5/2013 | Pepper | A61B 90/96 34/284 |
| 8,919,007 | B2 * | 12/2014 | Friess | F26B 5/06 356/73.1 |
| 10,377,520 | B2 * | 8/2019 | Root | B65D 81/245 |
| 10,443,935 | B2 * | 10/2019 | Knight | B01L 9/06 |
| 10,532,121 | B2 * | 1/2020 | Morhain | A01M 1/2044 |
| 10,793,327 | B2 * | 10/2020 | Weimer | A01N 1/0289 |
| 10,809,002 | B2 * | 10/2020 | Schuetz | B65B 3/003 |
| 11,246,802 | B2 * | 2/2022 | Tsakas | A61M 11/00 |
| 11,319,201 | B2 * | 5/2022 | Zumbrum | B67C 3/225 |
| 11,377,276 | B2 * | 7/2022 | Mueller | F26B 5/06 |
| 2009/0223080 | A1 | 9/2009 | McCarthy et al. | |
| 2010/0049156 | A1 | 2/2010 | Dickhorner et al. | |
| 2014/0259724 | A1 | 9/2014 | McCarthy et al. | |
| 2018/0209731 | A1 | 7/2018 | Knight | |
| 2021/0396467 | A1 * | 12/2021 | Deprez | F26B 5/06 |
| 2022/0023148 | A1 * | 1/2022 | Lema Martinez | A61J 1/2024 |

FOREIGN PATENT DOCUMENTS

| | | | | |
|---|---|---|---|---|
| FR | 3086739 | A1 * | 4/2020 | F26B 5/06 |
| JP | 2022501279 | A * | 1/2022 | |
| WO | WO-2014165222 | A1 * | 10/2014 | F26B 5/06 |
| WO | WO-2020065195 | A1 * | 4/2020 | F26B 5/06 |

* cited by examiner

LYOPHILISATION CONTAINER

CROSS-REFERENCE TO RELATED APPLICATIONS

This application is a National Phase of PCT/FR2019/052228, filed on Sep. 24, 2019, which claims priority to French Patent Application No. 1858895 Sep. 27, 2018, the disclosures of which are hereby incorporated by reference in their entireties.

The present invention relates to the field of lyophilization, and in particular equipment making it possible to lyophilize a liquid or semi-liquid product.

It preferably applies to the pharmaceutical field. In particular, the invention can be applied to liquid compositions for the lyophilization of proteins, antibodies, antigens or microorganisms (bacteria, parasites, viruses, phages). It can thus be applied to liquid compositions for the lyophilization of faeces, in particular in the context of preparations for the transplantation of intestinal flora.

Lyophilization is in fact a process which is commonly used in the preparation of pharmaceutical products, such as products in oral or injectable form.

Lyophilization consists of vacuum-drying a frozen product, using a process of sublimation. The lyophilization process comprises the following three successive stages: freezing, primary drying and secondary drying.

These three stages are generally performed in a piece of equipment called a freeze-dryer, comprising shelves often called "racks".

Two parameters are monitored throughout the process: the temperature (in the shelves or in the product) and the pressure inside the chamber.

The product to be lyophilized is held in a container, which can also be called a box or enclosure, and which withstands the temperature and pressure variations undergone during lyophilization.

In order to carry out the drying of the product, the container must make it possible to remove water vapour. Most containers dedicated to lyophilization are thus open systems. In the case of lyophilization of a suspension containing microorganisms, however, the use of open containers entails a risk of cross-contamination between the products and contamination of the freeze-dryer. This makes it necessary to carry out a cleaning of the equipment and to avoid simultaneous treatment of different batches of products.

Moreover, lyophilization is commonly carried out in stainless steel containers which make good thermal exchanges possible due to the high thermal conductivity of this material. However, such containers, which are expensive, must also be washed and decontaminated reliably in order to be re-used.

In order to make it possible to lyophilize a product while limiting the risk of contamination, document EP2157387 describes a rigid lyophilization box closed by a membrane which is vapour-permeable but forms an anti-bacterial barrier. This box is made of plastic, which makes a single use possible but does not facilitate thermal exchanges with the product that it holds.

Moreover, other problems persist.

The parameters (temperature, pressure, duration, etc.) used for the lyophilization must be adapted essentially according to the layer height of the product (i.e., for a liquid product, the distance between the bottom of the container and the free surface of the liquid). As a result, in order to keep parameters that are unchanged between different lyophilizations, it is necessary to lyophilize the same quantity of product in each container during a lyophilization batch, and this same quantity must always be lyophilized in each batch. On the other hand, if the quantity of product to be lyophilized varies from one batch to another, the layer height of the product in the lyophilization container varies, and the lyophilization parameters must be adapted, which is time-consuming.

A distribution of the product to be lyophilized into small individual containers, where necessary placed in one and the same lyophilization enclosure, is not a satisfactory solution, because it is time-consuming, both for filling the containers and for emptying them after lyophilization. Moreover, it is difficult to get the lyophilizates out of containers with small dimensions.

The invention thus aims to propose a device that solves all or some of the problems set out above.

The invention thus relates to a container for the lyophilization of a liquid or semi-liquid product comprising a container body comprising an upper portion provided with a membrane which is permeable to water vapour and a lower portion comprising a reservoir suitable for receiving the product on a bottom. The container comprises internal partitions in the reservoir which form a plurality of product-receiving volumes, the internal partitions being configured such that introducing product into a predefined one of the receiving volumes causes said receiving volumes to be successively filled in a predetermined order.

This makes it possible to lyophilize individualized and variable volumes of liquid, while having a substantially constant height of liquid to be lyophilized in the container. In fact, in the case of incomplete filling of the container, only some of the receiving volumes are filled, and completely full, with the possible exception of one partially filled volume, whereas the other receiving volumes are empty. As the full volumes have the same (or substantially the same) height of product to be lyophilized, the lyophilization parameters, and therefore the adjustments of the freeze-dryer, can remain unvarying or be slightly modified between two batches of product to be lyophilized.

In general, the invention makes it possible to lyophilize a product in a closed container which avoids the risks of contamination of the product by the environment outside the container or of the outside environment by the product, for example in the case of product containing microorganisms, or else when it is important to avoid any mixing of products in one and the same batch or from one batch to another (for example during the lyophilization of proteins).

The upper portion of the container can comprise a port for filling said container with product, said port supplying said predefined receiving volume.

A single port thus makes it possible to fill the whole container, wherein supplying said predefined receiving volume involves completely filling said receiving volumes successively.

By way of non-limitative example, the reservoir can comprise between two and eight product-receiving volumes.

According to an embodiment of the invention, the receiving volumes are arranged along a first row and a second row, the receiving volumes of the first row being separated by transverse partitions with a first height, the first row being separated from the second row by a longitudinal partition with a second height, which is greater than said first height, said longitudinal partition comprising, at the level of one of the receiving volumes at an end of the row, an indentation the upper edge of which is at a third height comprised between the first height and the second height.

According to an embodiment of the invention, the internal partitions forming the receiving volumes extend vertically from the bottom to the upper portion of the container, each receiving volume of the container, with the exception of the last volume in said predetermined order of successively filling the receiving volumes, being separated from the volume which succeeds it directly in said predetermined order by an internal partition comprising an indentation, such that when a given receiving volume is full and continues to be supplied with product it overflows into the successive receiving volume through the indentation formed in the partition which separates it from said successive receiving volume. An upper edge of each indentation can be at an identical height with respect to the bottom.

The receiving volumes can be arranged in contiguous rows comprising a first row and a second row, the filling of a first volume of the second row not starting until all the volumes of the first row are full and a last volume of the first row overflows into said first volume of the second row.

In all embodiments, the container body can consist of a biocompatible plastic material.

The reservoir can comprise a removable metal foil. The presence of a metal foil, for example an aluminium foil, in order to close the container increases the thermal conduction to the product, particularly as the product is in contact with this foil which forms the bottom of the container. This feature is particularly advantageous in the context of a container essentially made of plastic material. Moreover, getting the product out of the container after lyophilization can be made easier by removing or breaking the metal foil.

The upper portion of the container can have a central opening over which the membrane is placed.

The membrane is advantageously an antibacterial microporous hydrophilic membrane.

The upper portion can comprise a well making it possible to put a sensor in place. The container can comprise a pre-crushing device arranged opposite each of the receiving volumes and comprising one or more rigid protruding components pointing towards the bottom, the container moreover comprising retaining means configured to immobilize the upper portion with respect to the lower portion while the reservoir is being filled and during the lyophilization of the product and to allow, after lyophilization of the product, a relative movement between the upper portion and the lower portion involving bringing the pre-crushing device and the bottom closer together, such that the pre-crushing device breaks up the lyophilized product.

This makes it possible to break up the lyophilizate (this can also be called pre-crushing or pre-mincing) inside the lyophilization container. This avoids any risk of contamination both of the product by the outside environment and of the environment (machines, pestle, etc.) by the product during this step. This also avoids any loss of product during the pre-crushing.

The pre-crushing device can comprise one of the following rigid protruding components or a combination of at least two of the following rigid protruding components:

a peripheral wall, one or more peaks, a spiral wall, a parallelepipedal block, a parallelepipedal block a surface of which opposite the bottom comprises points.

The retaining means can comprise a removable tamper-proof belt placed between the upper portion and the lower portion.

Other features and advantages of the invention will also become apparent from the description below.

In the attached drawings, given by way of non-limitative examples:

FIG. 1 shows a container according to an embodiment of the invention. This container is suitable for containing a liquid or semi-liquid product and to be placed on a shelf of a freeze-dryer in order to carry out the lyophilization of the product.

Figure 1:
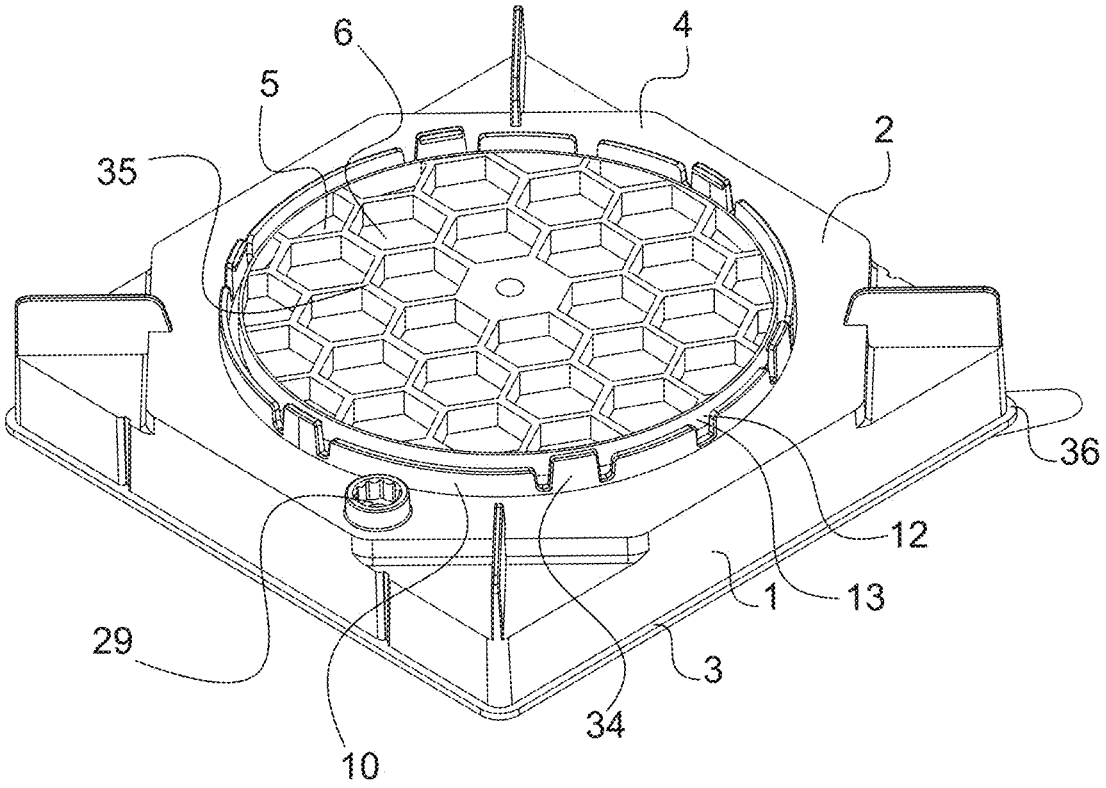
FIG. 1 shows a three-dimensional diagrammatic view of a container according to an embodiment of the invention.

The container comprises a container body 1 which is formed of an upper portion 2 and a lower portion 3. The upper portion 2 corresponds to the portion situated at the top of the container when the latter rests on a horizontal surface in the operating position, such as for example placed on a freeze-dryer shelf. The lower portion 3 is situated underneath the upper portion 2. The container rests on the lower portion 3. In the embodiment example shown here, the upper portion 2 and the lower portion 3 are in one piece and form a body of the container.

The upper portion 2 of the container body 1 comprises an upper wall 4 penetrated by an opening 5 over which a membrane 6 is positioned. The membrane 6 is configured in order to make it possible to remove the water vapour produced during the lyophilization of the product held in the container. The membrane 6 is thus permeable to water vapour. However, the membrane 6 advantageously constitutes an anti-bacterial barrier. A hydrophilic porous membrane having pores with a diameter of the order of 0.22 microns is suitable for forming such a barrier. The porosity is expressed conventionally here, and the membrane is very obviously not limited to a material comprising strictly spheroidal pores, nor to pores of strictly 0.22 microns. A porosity of 0.22 microns corresponds to the conventional porosity of a sterilizing filtration membrane, and corresponds to the maximum pore diameter observed on the membrane. However, any porous membrane forming a barrier with respect to bacteria can be envisaged. More generally, depending on the application, other porosities can be envisaged without departing from the scope of the invention. A lower porosity (membrane with smaller-diameter pores) can be used to lyophilize proteins, as long as the membrane makes it possible to remove the water vapour. A membrane with higher porosity (membrane with larger-diameter pores, for example of 5 microns) can be used, for example, for the lyophilization of yeasts.

The membrane 6 can in particular consist of polyethersulfone (PES), polytetrafluoroethylene (PTFE) or nitrocellulose.

On the upper portion 2 of the container, a rim 10 can be formed along the circumference of the opening 5. The rim 10 is configured to receive a flange 11, making it possible to secure the membrane 6, for example by pinching between the flange 11 and the upper portion 2 of the body of the container.

The flange 11 can be clipped to the body of the container by suitable means, for example clip tongues 34. Notches 12 made in the rim 10 and pins 13 formed corresponding thereto on the flange 13 make a precise angular indexing between these two parts possible.

The membrane 6 can be secured by pinching between the flange 11 and the rim 10. Alternatively, it can be secured for example by soldering either to the upper portion 2 (for example to the rim 10) or to the assembly intended to be mounted on the upper portion 2 (for example to the flange 11). In order to hold and protect the membrane 6 while making gas exchanges between the inside and the outside of the container possible, the flange 11 comprises an open mesh 35, formed for example in hexagonal patterns.

To fill the container with product to be lyophilized, a port 29 is made in the upper wall 4 of the container body, above the first receiving volume 22 (the receiving volume called predetermined receiving volume).

The port 29 is advantageously of the Luer connector type, corresponding to a standardized connector type that is widespread in the field of laboratory equipment. In particular, the port 29 can be, for example, the female part of a Luer connector. A cap (not shown in FIG. 1) is provided for closing the port 29 before and after the container is filled. The cap can typically have a male part of a Luer connector. The distribution of the male part and the female part of the connector can obviously be reversed. Moreover, other connectors can be used, in particular for large volumes of products, including the quick-release couplings commonly used in laboratories called MPX-type connectors or also the connectors equipped with a membrane making an aseptic connection outside a clean room or a laminar flow cabinet (LFC) possible.

Figure 2:
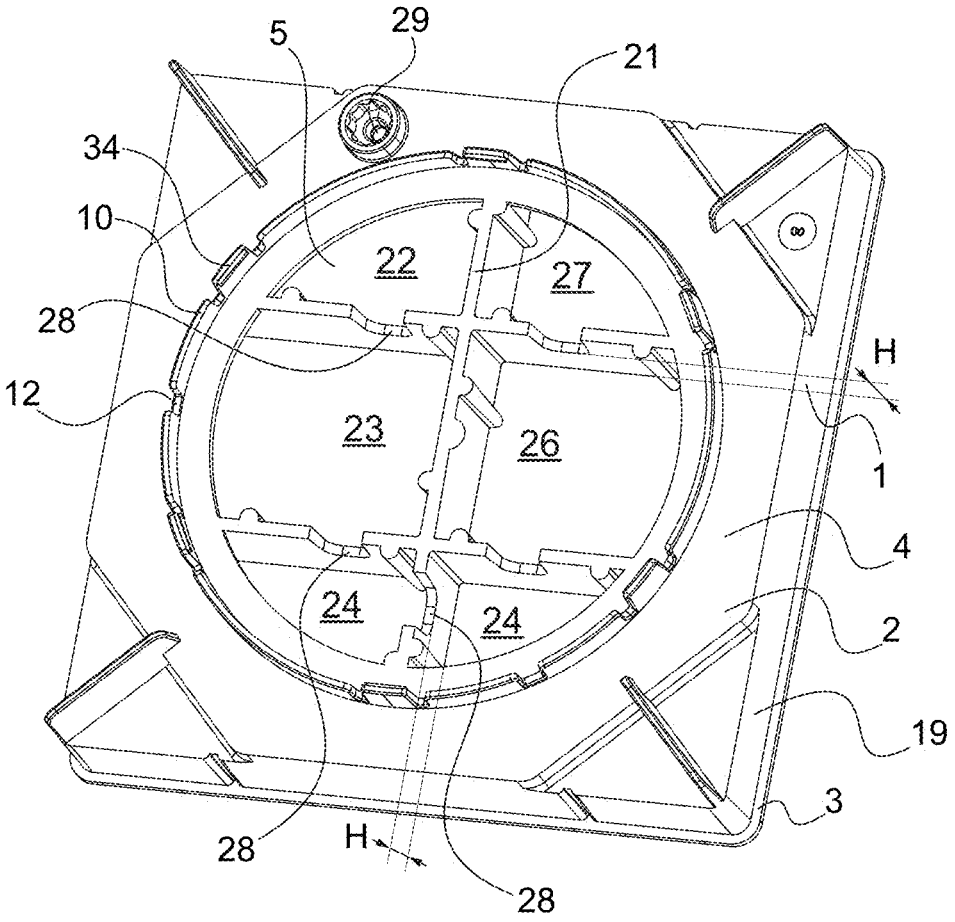
FIG. 2 shows a first three-dimensional diagrammatic view of a container body used in the embodiment in FIG. 1.
Figure 3:
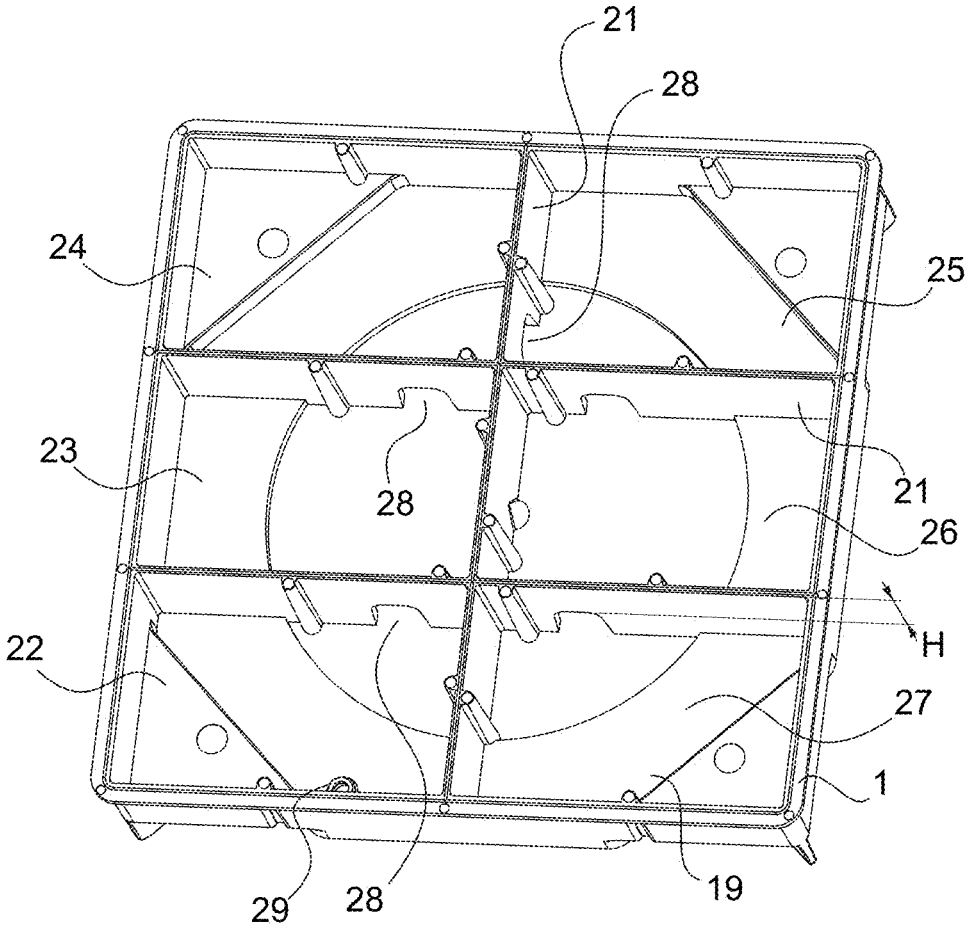
FIG. 3 shows a second three-dimensional diagrammatic view of a container body used in the embodiment in FIG. 1.

FIG. 2 illustrates an example of the body of the container 1 of FIG. 1, in a three-dimensional view from above. FIG. 3 illustrates the same container body 1 seen from below. The container body 1, in one piece, forms a reservoir 19. The reservoir 19 denotes the volume suitable for receiving the liquid (or semi-liquid) product to be lyophilized. The reservoir comprises a bottom 20, which is also the bottom 20 of the container in this embodiment.

The bottom 20 can advantageously consist of a metal foil which is applied to the lower face of the body of the container, and which is secured thereto. The metal foil can in particular be secured by adhesion (bonding) or soldering. The metal foil can advantageously be pulled off the rest of the reservoir manually. A tab 36 (shown in FIG. 1) which is situated on an edge of the metal foil and which is not secured to the rest of the reservoir can make it easier to pull the foil off. This makes it possible to recover the product easily and without loss after lyophilization.

The metal foil can be an aluminium foil, bearing a protective coating or not.

The container body forming the reservoir in this embodiment (with the exception of the bottom 20), and more generally the components constituting the container, can be made of plastic material, in particular of biocompatible plastic material, for example of medical-grade plastic such as polyethylene or polypropylene. In this case, the bottom 20 formed of a metal foil makes it possible to greatly increase the thermal conductivity to the product to be lyophilized.

The reservoir can comprise, as in the example shown here, internal partitions 21 which form several receiving volumes (22-27) which can be filled with the liquid or semi-liquid product to be lyophilized.

The container is configured such that the product is always introduced therein at the level of the same (first) predefined receiving volume 22. For this purpose, the port 29 overhangs the predefined receiving volume 22, such that the product is introduced into this predefined receiving volume 22. The internal partitions 21 are configured such that the receiving volumes fill successively in a predefined order (a receiving volume only starting to fill if the preceding receiving volume is full). In the embodiment example shown here, every internal partition 21 has a height such that the partition extends from the bottom 20, i.e. from the lower face of the reservoir 19 and the container, to the internal face of the upper wall 4 of the upper portion 2 of the container.

In the example shown, the second receiving volume 23 fills by overflow from the first receiving volume 22 via an indentation 28 formed in the internal partition 21 which separates said first receiving volume 22 from the second receiving volume 23. The third receiving volume fills when the second receiving volume 23 is full, by overflow from the second volume via an indentation 28 formed in the internal partition 21 which separates it from the third volume 24. Then the fourth receiving volume 25 fills when the third receiving volume 24 is full, by overflow via an indentation 28 formed in the partition which separates them. The fifth receiving volume 26 then fills by overflow of the product via an indentation 28 formed in the internal partition which separates it from the fourth receiving volume 25. Finally, if the introduction of product is continued, the sixth receiving volume 27 is filled in its turn.

The introduction of product can very obviously be stopped at any time, such that only some of said receiving volumes (22-27) are filled. This makes it possible to obtain a height of product to be lyophilized that is substantially identical in every container or between different batches of product to be lyophilized (with the possible exception of the case where a receiving volume is partially filled). This makes it possible to use substantially constant lyophilization parameters, which simplifies the adjustment of the freeze-dryer and guarantees a constant and reproducible result of the lyophilization.

The indentations 28 formed in the internal partitions 21 can have an upper edge situated at one and the same height H from the bottom 20.

Alternatively, the height of the upper edge of the indentations 28 formed in the internal partitions 21 can vary slightly, for example by decreasing slightly in the order of filling the receiving volumes.

In order to arrive at this result, the internal partitions 21 are secured to the bottom 20 in a watertight manner. The bottom 20, for example in the form of a metal foil or plastic film, can be sealed at the level of the lower faces of the partitions 21. The receiving volumes can be organized in rows, in this case and by way of example in two rows consisting, respectively, of the first, second and third receiving volume (22, 23, 24) for a first row and of the fourth, fifth and sixth receiving volume (25, 26, 27) for a second row.

Figure 4:
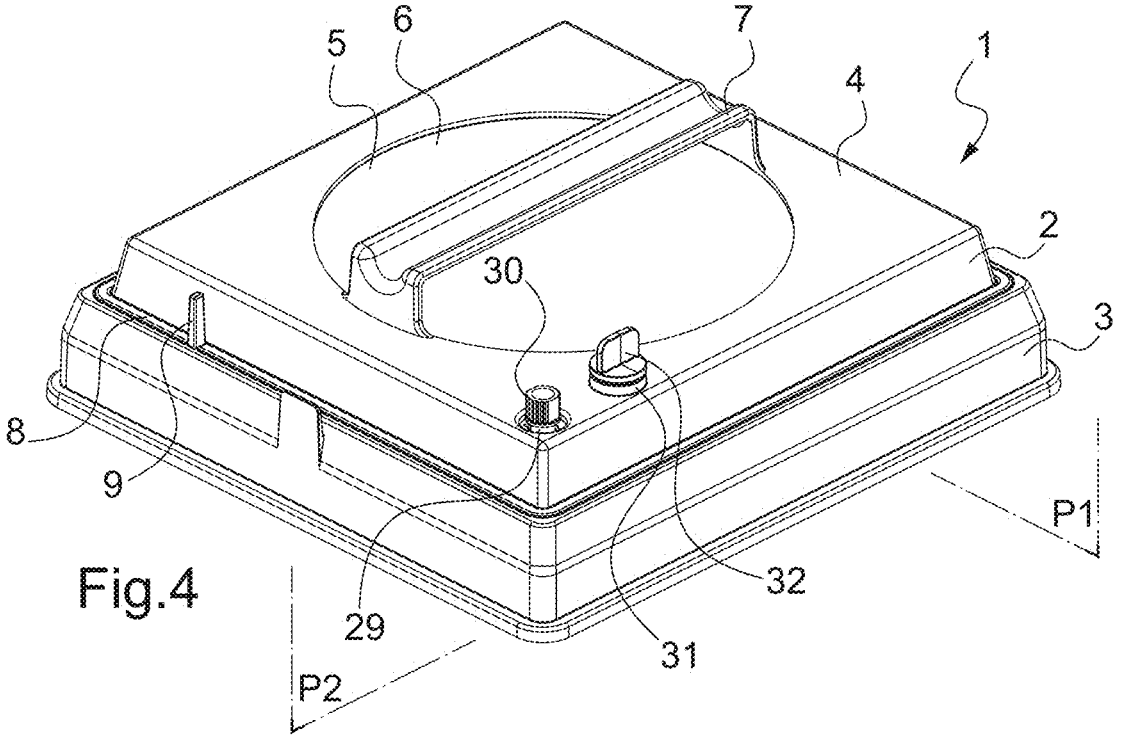
FIG. 4 shows a three-dimensional diagrammatic view of a container according to another embodiment of the invention.

FIG. 4 shows a second embodiment of the invention, in which the container comprises a device for pre-crushing the lyophilizate.

The container of FIG. 4 has a general composition identical to that of FIG. 1, in that it comprises in particular a container body 1 which is formed of an upper portion 2 and a lower portion 3. Similarly, the upper wall 4 of the upper portion 2 is penetrated by an opening 5 over which a membrane 6 is positioned.

Unlike in the embodiment in FIG. 1, the upper portion 2 and the lower portion 3 are formed of two portions which are distinct or separated by a deformable component, such that they can be mobilized relative to each other as detailed below.

The upper portion 2 is provided with a handle 7 making it possible to transport and manipulate the container. This feature is furthermore applicable to any embodiment of the invention. The handle 7 can in particular be arranged above the opening 5 made in the upper wall 4. The handle 7 can have a curved shape, which increases its rigidity.

The upper portion 2 is fixed with respect to the lower portion 3, as long as retaining means are in place between these two portions. In the example shown here, a tamper-proof belt 8 is arranged at the interface between the upper portion 2 and the lower portion 3. The tamper-proof belt 8 essentially consists of a rigid band placed between the upper portion 2 and the lower portion 3. The tamper-proof belt 8 is joined to the container body 1 removably. Removing the tamper-proof belt 8 partially or completely divides the upper portion 2 from the lower portion 3 so as to make it possible for them to move relative to each other in vertical translation (i.e. movement of the upper face 4 towards the base of the container). In the embodiment example shown here, the upper portion 2 can be returned, in part, to the inside of the lower portion 3. In order to make it easier to remove the tamper-proof belt 8, the latter can be equipped with a grip tab 9 at one of its ends.

Other retaining means can be envisaged without departing from the scope of the invention. Any removable component placed between the upper portion 2 and the lower portion 3 can be used. Alternatively, pins or other components made of breakable material can be placed between the upper portion 2 and the lower portion 3. Clips can be provided, which can be forced open under the effect of a sufficient force.

Figure 5:
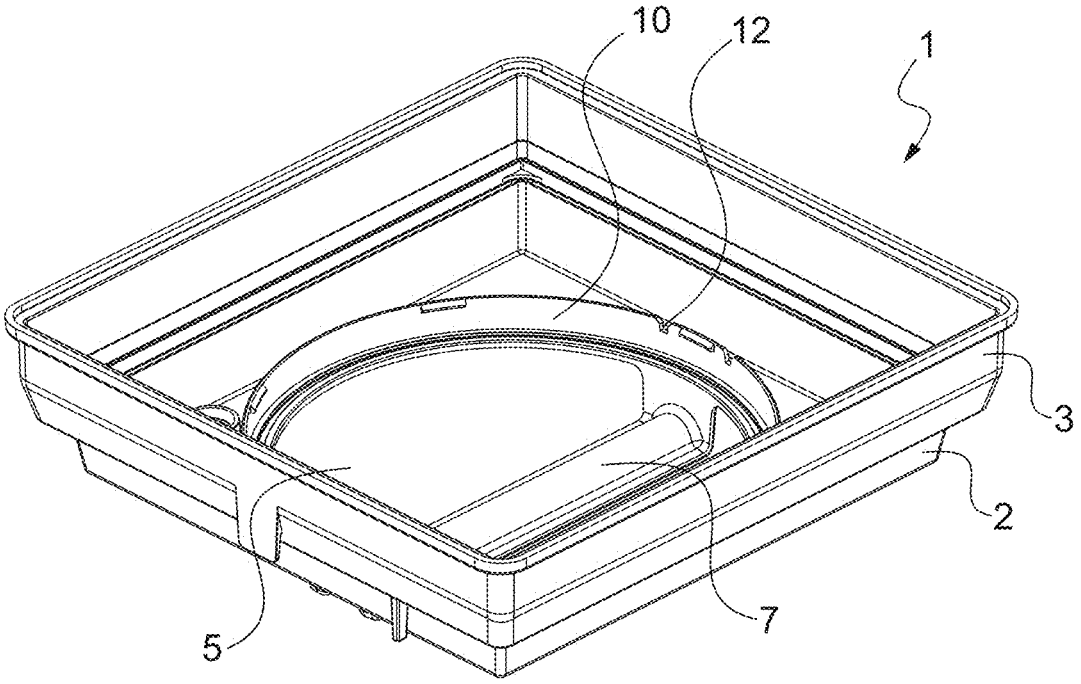
FIG. 5 shows a three-dimensional diagrammatic view of a container body used in the embodiment in FIG. 4.

FIG. 5 shows the container body 1, seen from below. The container body 1 here is shown not provided with the membrane permeable to water vapour. Underneath the opening 5, i.e. inside the container body 1, a rim 10 is formed which makes it possible to hold an assembly of pre-crushing devices as shown in FIG. 3.

Figure 6:
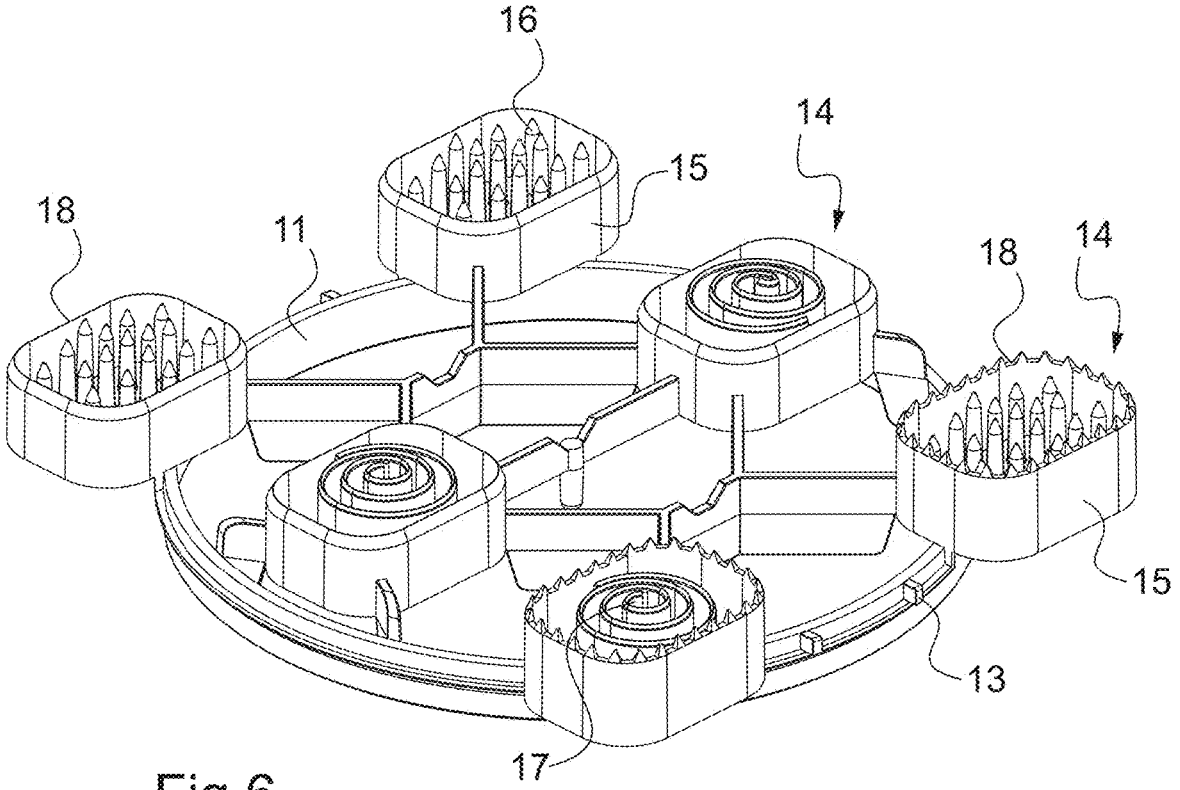
FIG. 6 shows a three-dimensional diagrammatic view of an assembly of pre-crushing means which can be used in a container according to an embodiment of the invention.

The assembly shown in FIG. 6 comprises a flange 11 suitable for being mounted, for example by clipping, on the rim 10. Notches 12 made in the rim 10 and pins 13 formed corresponding thereto on the flange 13 make a precise angular indexing between these two parts possible.

The membrane 6 can be secured by pinching between the flange 11 and the rim 10. Alternatively, it can be secured for example by soldering either to the upper portion 2 (for example to the rim 10) or to the assembly intended to be mounted on the upper portion 2 (for example to the flange 11).

The flange 11 moreover comprises, in the embodiment shown, an assembly of ribs which ensures the solidity and the rigidity of the assembly, and provides a support for one or more pre-crushing devices 14. In the example shown here, six pre-crushing devices are provided. Each pre-crushing device is intended to pre-crush a portion of the lyophilizate, as detailed below. The pre-crushing devices can take different forms. Different pre-crushing devices are shown in FIG. 6. The assembly used in the invention for pre-crushing, i.e. breaking up, the lyophilizate can comprise one or more pre-crushing devices 14. When it comprises several pre-crushing devices 14, the pre-crushing devices 14 can be identical to or different from each other, and in particular can be one of the types described below.

The pre-crushing devices shown here each comprise a peripheral wall 15. The peripheral wall 15 delimits a volume inside which a protruding component extends which is suitable for breaking up the lyophilizate. In particular, several peaks 16 can be formed. Alternatively, one (or more) spiral wall(s) 17 can be formed. The spiral wall 17 can have a decreasing height from its centre to the outside of the spiral. In every embodiment, the peripheral wall 15 can have a smooth or notched free edge 18 in order to make it easier to break the lyophilizate up.

In general, the pre-crushing devices used are configured to make it possible to break up a dry product, under the effect of a pressure force applied to said pre-crushing device.

In general, the pre-crushing device comprises one or more rigid protruding components. The protruding component or components, once mounted (or formed) in the lyophilization container, point towards the bottom thereof as is described below.

The pre-crushing devices 14 can be made of plastic material (biocompatible plastic material, for example medical-grade plastic such as polyethylene or polypropylene) or made completely or partially of biocompatible metal such as aluminium or stainless steel.

Once the assembly has been secured to the rim 10, it becomes integral with the upper wall 4 and more generally the upper portion 2 of the container body. The pre-crushing device (or devices) 14 is thus mobilized with the upper portion 2 during its movement with respect to the lower portion 3.

Figure 7:
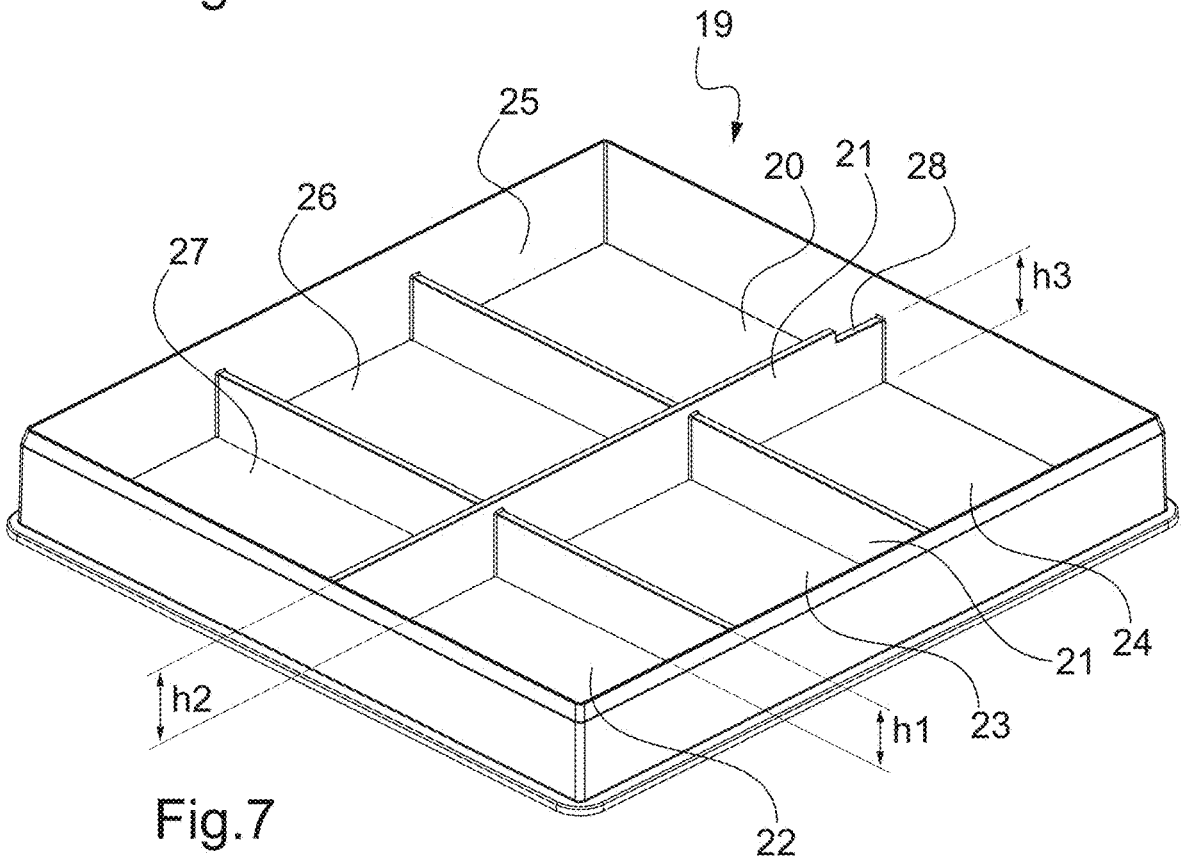
FIG. 7 shows a three-dimensional diagrammatic view of a reservoir which can be used in a box according to the invention.

FIG. 7 illustrates an example of a reservoir 19 which can be used in the invention. The reservoir 19, as a volume for receiving the product to be lyophilized, in this embodiment, essentially consists of a tank capable of receiving the liquid (semi-liquid) product before being lyophilized. The reservoir comprises a bottom 20, which also forms the bottom 20 of said container after the reservoir has been assembled with the container body.

The bottom 20 of the reservoir can, just like in the embodiment in FIGS. 1 to 3, advantageously consist of a metal foil applied to the lower face of the rest of the reservoir and secured thereto. The metal foil can in particular be secured by adhesion (bonding) or soldering. The metal foil can advantageously be pulled off the rest of the reservoir manually. A tab which is situated on an edge of the metal foil and which is not secured to the rest of the reservoir can make it easier to pull the foil off.

The reservoir (with the exception of the bottom 20), just like the container body, and more generally the components constituting the container, can be made of plastic material, in particular of biocompatible plastic material, for example of medical-grade plastic such as polyethylene or polypropylene. The reservoir can comprise, as in the example shown here, internal partitions 21 which form several receiving volumes (22-27) which can be filled with the liquid or semi-liquid product to be lyophilized.

Just like in the embodiment in FIGS. 1 to 3, the product is introduced at the level of a first predefined receiving volume.

In the example shown, the second receiving volume 23 fills by overflow from the first receiving volume 22 above the internal partition 21 which separates said first receiving volume 22 from the second receiving volume 23. The third receiving volume fills when the second receiving volume 23 is full, by overflow from the second receiving volume above the internal partition which separates them. Then the fourth receiving volume 25 fills when the third receiving volume is full, by overflow at the level of the partition which separates it from the third receiving volume 24. The fifth receiving volume 26 then fills by overflow of the product above the internal partition which separates it from the fourth receiving volume 25. Finally, if the introduction of product is continued, the sixth receiving volume 27 is filled in its turn.

Just like in the embodiment in FIGS. 1 to 3, the introduction of product can very obviously be stopped at any time, such that only some of said receiving volumes (22-27) are filled.

The internal partitions 21 are secured to the bottom 20 in a watertight manner and have suitable heights. Thus, the receiving volumes are organized in rows, in this case and by way of example in two rows consisting, respectively, of the first, second and third receiving volume (22, 23, 24) for a first row and of the fourth, fifth and sixth receiving volume (25, 26, 27) for a second row.

Thus, the internal partitions which separate, respectively, the first receiving volume 22 from the second receiving volume 23 and the second receiving volume 23 from the third receiving volume 24 have one and the same first height h1 (measured from the bottom 20 of the reservoir 19).

An internal partition called a longitudinal partition, which separates the first row from the second row, has a second height h2, which is greater than h1. However, an indentation 28 is formed in this partition. The indentation 28 has an upper edge at a third height h3 comprised between the first height h1 and the second height h2. Thus, during filling of the reservoir, when the product has filled the receiving volumes of the first row, its level exceeds the first height h1 and then reaches the second height h3. At this moment, it starts to pour into the second row through the indentation 28. It is noteworthy that h3 can be equal to h1.

The internal partitions 21 which separate the receiving volumes of the second row have a fourth height h4, which is preferably identical. The fourth height h4 can have any value comprised between zero and h3, but it seems that, in order to ensure product layer heights that are substantially equal in the different receiving volumes, it is advantageous for h4 to be equal or substantially equal to h1, and furthermore for h3 to be only slightly greater than h1.

Numerous other reservoir configurations based on the principle set out above can be envisaged. For example, the filling order could be organized differently, in a spiral, from one side to the opposite side, etc. Depending on the application, receiving volumes that are smaller or larger can be formed. In particular, large receiving volumes can be formed for products the lyophilizate of which is easy to break up, and receiving volumes with small dimensions can be favoured for products the lyophilizate of which is difficult to break up or requires a pre-crushing into pieces with a small size.

Figure 8:
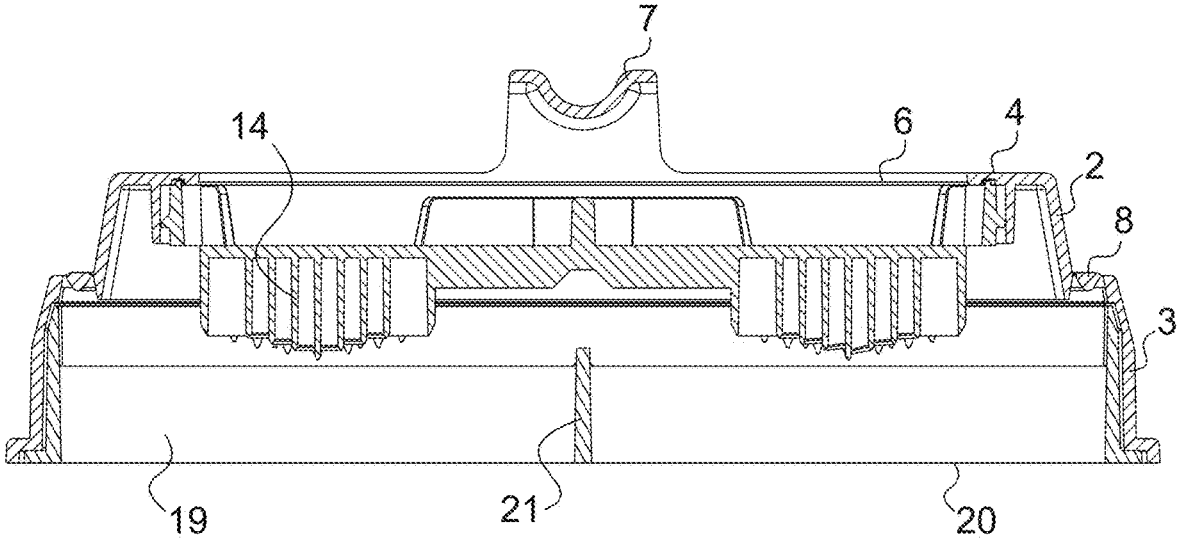
FIG. 8 shows the container of FIG. 4 in a cross-section view.

FIG. 8 is a cross-section view, along the section plane P1 shown in FIG. 4, of the container. The reservoir 1 is assembled securely in the lower portion 3 of the container body 1.

When the container is assembled, as illustrated in FIG. 8, a pre-crushing device 14 is arranged above each receiving volume (22-27).

Figure 9:
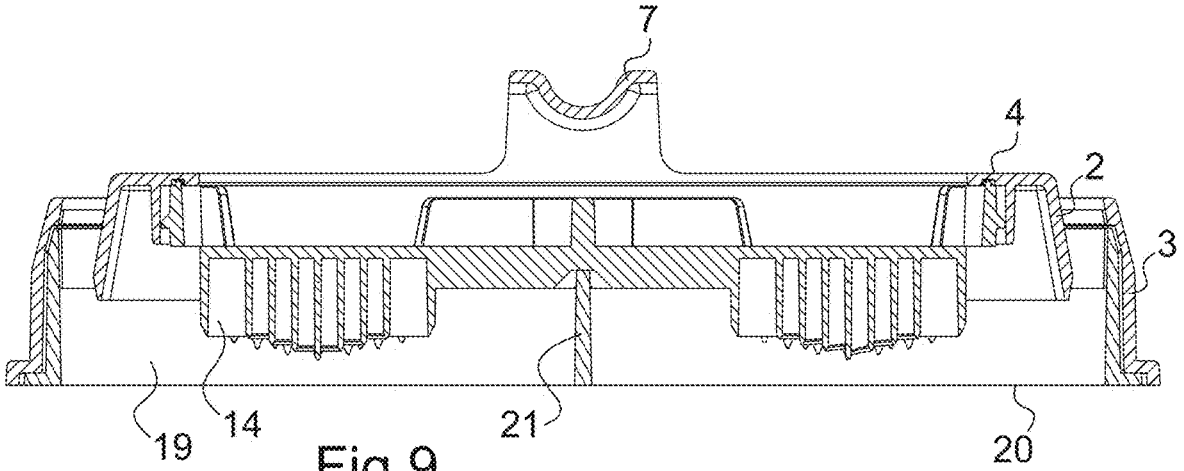
FIG. 9 shows the container of FIG. 4, in a cross-section view analogous to that of FIG. 8, in a pre-crushing configuration.

Removing the tamper-proof belt 8 makes it possible to push the upper portion 2 into the lower portion 3, in order to put the container in the configuration illustrated in FIG. 9. The handle 7 can be used to press on said upper portion 2. Thus, in addition to its role in handling the container, the handle 7 can have a function of actuating the container for the pre-crushing of the lyophilizate. In the configuration in FIG. 9, the pre-crushing devices 14 have been brought closer to the bottom 20 of the reservoir 19 and the container, such that a lyophilizate present in a receiving volume of the reservoir is broken, broken up, by the pre-crushing device introduced into this receiving volume.

The handle 7 can also be used to pull the upper portion 2 upwards, in order to bring the container into its initial configuration. This makes it possible to make the container pass between the configurations shown respectively in FIG. 8 and FIG. 9 several times in succession. This succession makes it possible to break the lyophilizate up more easily and/or into more numerous pieces with smaller dimensions.

Figure 10:
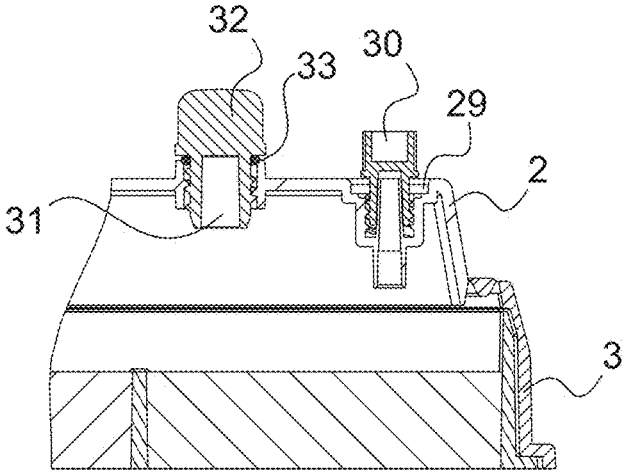
FIG. 10 shows a cross-section view of an embodiment detail of the container of FIG. 4.

FIG. 10 shows a cross-sectional detail view of the container of FIG. 4, along a section plane P2 shown in FIG. 4. The container is equipped, in its upper portion 2, with two interfaces which are shown more precisely in FIG. 10.

To fill the container with product to be lyophilized, a port 29 is made in the upper wall 4 of the container body, above the first receiving volume 22 (the receiving volume called predetermined receiving volume). The port 29 can be, for example, of the type described with reference to the embodiment in FIG. 1. The cap 30 closing the port 29 is shown in FIG. 4.

The upper wall 4 moreover comprises a well 31 suitable for putting a sensor in place. This sensor can be introduced directly into the well 31 or positioned in a thimble secured in the well 31. Such a sensor can make it possible for example to monitor the environmental parameters (temperature, pressure, humidity, etc.) in the container during, or even after, the lyophilization. A cover 32 makes it possible to close the well 31, if said well 31 is not provided with a sensor. The watertightness of the well 31, whether it is closed by the cover 32 or provided with a sensor, can be obtained for example due to a seal 33. Such a well can be provided in all of the embodiments of the invention, in particular in the embodiment presented in FIGS. 1 to 3.

A lyophilization process using a container such as described previously can thus comprise the following steps. A liquid or semi-liquid product (or "composition") is supplied. It is introduced, in the desired quantity, into a container such as described previously, typically via the port 29, which is then closed by the cap 30. All of the receiving volumes or only some receiving volumes of the reservoir 19 are filled. The container is placed in a freeze-dryer. The lyophilization process is performed, during which the heat transfer to the product is promoted by the bottom 20 formed of a metal foil, and during which the water vapour is removed from the container through the membrane 6. Once the lyophilization of the product has been completed, a lyophilizate, which is solid, is obtained in the reservoir 1 (in the receiving volumes filled at the start). The container is taken out of the freeze-dryer.

If the container is configured according to an embodiment comprising pre-crushers, the tamper-proof belt 8 is taken away. A pressure on the handle 7 makes it possible to push the upper portion 2 in the direction of the bottom 20, which lowers the pre-crushing device (or devices) 14. The pre-crushing device 14 comes into contact with the lyophilizate, penetrates it and breaks it up. The handle 7 can optionally be raised and lowered several times.

The bottom 20, formed of a metal foil, is pulled off, releasing the lyophilizate, pre-crushed or not. The lyophilizate is introduced, directly or after being broken up, into a grinder in order to be ground therein with a view to its future use.

Although presented in connection with a container comprising a plurality of receiving volumes, the pre-crushing device described above can be used with a single receiving volume in the container. The dimensions of the pre-crusher are adapted depending on the dimensions of the receiving volume.

In fact, when it is taken out of the container used for the lyophilization, the product, with the known lyophilization containers, is in the form of a lyophilizate in a block, also called a "cake". After lyophilization of a liquid product, it is thus generally necessary to grind it in order to reduce it to powder before being able to package it, whatever the packaging form may be (sachets, capsules, tablets, injectable forms, etc.).

The cake must be crushed in several successive steps. One (or more) pre-crushing process(es) is/are necessary in order to break the lyophilizate block into pieces that can be effectively ground in a grinder.

This succession of steps can be detrimental when the lyophilized products are likely to contaminate the tools and the environment in which they are treated, and/or when the product has a high added value (because the successive manipulations lead to a potential loss of product).

An aspect described here thus relates to a container for the lyophilization of a liquid or semi-liquid product comprising a container body comprising an upper portion provided with a membrane which is permeable to water vapour and a lower portion comprising a reservoir suitable for receiving the product on a bottom, in which the upper portion comprises a pre-crushing device comprising one or more rigid protruding components pointing towards the bottom, the container moreover comprising retaining means configured to immobilize the upper portion with respect to the lower portion while the reservoir is being filled and during the lyophilization of the product and to allow, after lyophilization of the product, a relative movement between the upper portion and the lower portion involving bringing the pre-crushing device and the bottom closer together, such that the pre-crushing device breaks up the lyophilized product.

In particular, the pre-crushing device can comprise one of the following rigid protruding components or a combination of at least two of the following rigid protruding components:

a peripheral wall, one or more peaks, a spiral wall, a parallelepipedal block, a parallelepipedal block a surface of which opposite the bottom comprises points.

If the reservoir comprises a plurality of receiving volumes, a pre-crushing device is advantageously arranged opposite each of the receiving volumes.

The retaining means can comprise a removable tamper-proof belt placed between the upper portion and the lower portion.

The upper portion can comprise a handle for handling and actuating the breaking up of the lyophilized product.

This aspect offers a container which makes it possible to break up the lyophilizate (this can also be called pre-crushing or pre-mincing) inside the lyophilization container. This avoids any risk of contamination both of the product by the outside environment and of the environment (machines, pestle, etc.) by the product during this step. This also avoids any loss of product during the pre-crushing.

In the invention a container for the lyophilization of a product is thus proposed which makes it possible to lyophilize different quantities of product while having a product layer height in the container that is substantially identical. The lyophilization parameters, and therefore the adjustments of the freeze-dryer, can thus remain unvarying or be slightly modified between two batches of product to be lyophilized.

According to some embodiments, the invention makes it possible to break up the lyophilizate directly in the container. The container avoids any risk of contamination and loss of product by limiting the steps performed outside the container, as well as by optimizing the filling thereof and the recovery of the lyophilized product.

The container that is the subject of the invention is preferably intended for a single use. It can have numerous applications in the food sector or in the medical field. One particular application of the invention is the lyophilization of a suspension of microorganisms, for example a bacteriotherapy product in particular for a transplant or "graft" of intestinal flora.

In comparison with a container made entirely of plastic material, the presence of a bottom formed of a metal foil in some embodiments of the invention makes it possible to improve the thermal conductivity to the product, and therefore to reduce the duration of the lyophilization process. A bottom that is removable (for example by being pulled off) also makes it possible to recover the lyophilized product simply and without loss.

The invention claimed is:

1. A container for the lyophilization of a liquid or semi-liquid product comprising:

a container body comprising an upper portion provided with a membrane which is permeable to water vapour and a lower portion comprising a reservoir suitable for receiving the product on a bottom;

wherein the container comprises internal partitions in the reservoir which form a plurality of product-receiving volumes, the internal partitions being configured such that an introduction of product into a predefined one of the receiving volumes causes said receiving volumes to be successively filled in a predetermined order; and wherein the membrane is an antibacterial microporous hydrophilic membrane.

2. The container of claim 1, wherein the upper portion comprises a port for filling said container with product, said port supplying said predefined receiving volume.

3. The container of claim 1, wherein the reservoir of which comprises between two and eight product-receiving volumes.

4. The container of claim 1, wherein the receiving volumes are arranged along a first row and a second row, the receiving volumes of the first row being separated by transverse partitions with a first height, the first row being separated from the second row by a longitudinal partition with a second height, which is greater than said first height, said longitudinal partition comprising, at a level of one of the receiving volumes at an end of the first row, an indentation having an upper edge, wherein the upper edge is at a third height comprised between the first height and the second height.

5. The container of claim 1, wherein the internal partitions forming the receiving volumes extend vertically from the bottom to the upper portion of the container, each receiving volume of the container, except that a last volume in said predetermined order of successively filling the receiving volumes, being separated from a volume which succeeds said receiving volume directly in said predetermined order by an internal partition comprising an indentation, such that when a given receiving volume is full and continues to be supplied with product it overflows into the successive receiving volume through the indentation formed in the partition which separates said receiving volume from said successive receiving volume.

6. The container of claim 5, wherein an upper edge of each indentation is at an identical height with respect to the bottom.

7. The container of claim 5, wherein the receiving volumes are arranged in contiguous rows comprising a first row and a second row, the filling of a first volume of the second row not starting until all the volumes of the first row are full and a last volume of the first row overflows into said first volume of the second row.

8. The container of claim 1, wherein the container body consists of a biocompatible plastic material.

9. The container of claim 1, wherein the bottom of the reservoir comprises a removable metal foil.

10. The container of claim 1, wherein the upper portion has a central opening over which the membrane is placed.

11. The container of claim 1, wherein the upper portion of which comprises a well suitable for putting a sensor in place.

12. The container of claim 1, wherein the upper portion comprises a pre-crushing device arranged opposite each of the receiving volumes and comprising one or more rigid protruding components pointing towards the bottom, the container further comprising retaining means configured to immobilize the upper portion with respect to the lower portion while the reservoir is being filled and during lyophilization of the product and to allow, after lyophilization of the product, a relative movement between the upper portion and the lower portion involving bringing the pre-crushing device and the bottom closer together, such that the pre-crushing device breaks up the lyophilized product.

13. The container of claim 12, wherein the pre-crushing device comprises one of the following rigid protruding components or a combination of at least two of the following rigid protruding components:

- a peripheral wall,
- one or more peaks,
- a spiral wall,
- a parallelepipedal block, and/or
- a parallelepipedal block a surface of which opposite the bottom comprises points.

14. The container of claim 12, wherein the retaining means comprise a removable tamper-proof belt placed between the upper portion and the lower portion.

* * * * *